United States Patent [19]

Wilbur

[11] 3,979,046

[45] Sept. 7, 1976

[54] SPECIAL SHIPPING CASE HAVING MODIFIED END FLAPS

[75] Inventor: Charles J. Wilbur, Barrington, Ill.

[73] Assignee: The Quaker Oats Company, Chicago, Ill.

[22] Filed: Feb. 27, 1975

[21] Appl. No.: 553,565

[52] U.S. Cl. ..... 229/37 R; 229/45 R

[51] Int. Cl.[2] ..... B65D 5/18; B65D 5/36

[58] Field of Search ..... 229/37 R, 37 E, 38, 229/39 R, 44 R, 45, 3.1

[56] References Cited

UNITED STATES PATENTS

| | | | |
|---|---|---|---|
| 1,211,857 | 1/1917 | Johnson | 229/37 R X |
| 1,223,232 | 4/1917 | Ash | 229/37 R |
| 3,007,376 | 11/1961 | Hickin et al. | 229/37 R X |
| 3,356,278 | 12/1967 | Layne, Sr. | 229/37 R X |
| 3,357,629 | 12/1967 | Smith | 229/37 R |
| 3,362,614 | 1/1968 | Farquhar | 229/37 R |
| 3,519,194 | 7/1970 | Kohlhaas et al. | 229/37 R X |
| 3,743,167 | 7/1973 | Russell | 229/45 |

*Primary Examiner*—Davis T. Moorhead

[57] ABSTRACT

Tops of shipping cases are routinely severed for price marking of package contents, and this process incurs substantial cutting of contents, e.g. cereal packages and the like. Although package contents adjacent side panels are most likely to be cut by the store clerk, a substantial number of packages adjacent the end flaps are also likely to be cut, specifically those packages positioned at the end-flap gap. A shipping case is disclosed which substantially eliminates this kind of damage to the contents, and increases the strength of the case. In accordance with the present invention the shipping case includes a top panel having dependent major end flaps extending downwardly over minor end flaps, the dependent flaps being free of any connection to the minor end flaps along the entire edge adjacent the top panel, and being attached to said dependent flaps beyond this zone of unattachment. The case minor end flaps have attached at their top middle edges separation strips of the corrugated material.

14 Claims, 15 Drawing Figures

FIG. 1
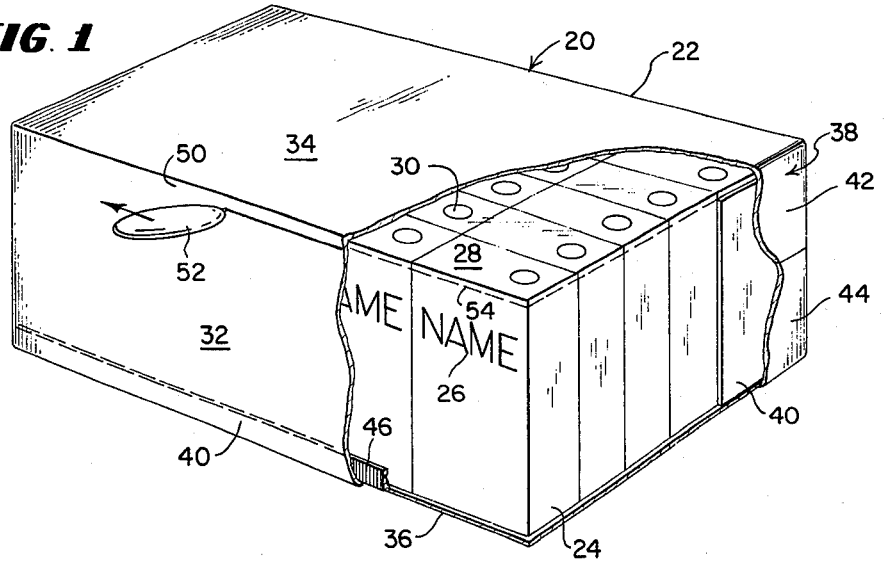
FIG. 2
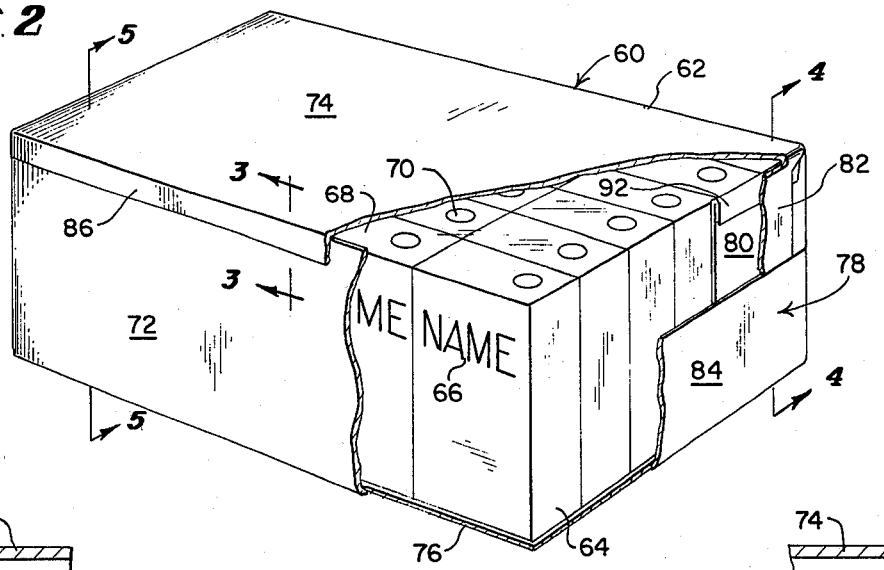
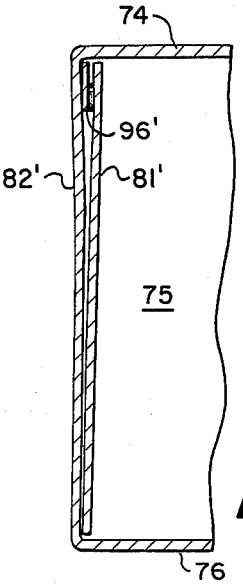
FIG. 5
FIG. 3
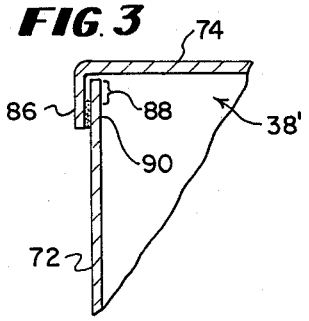
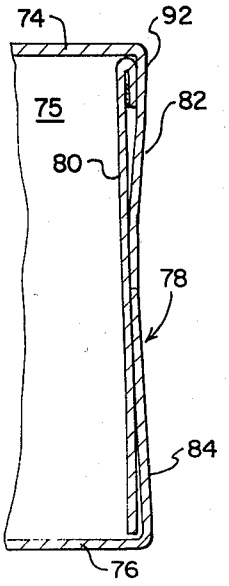
FIG. 4

FIG. 15
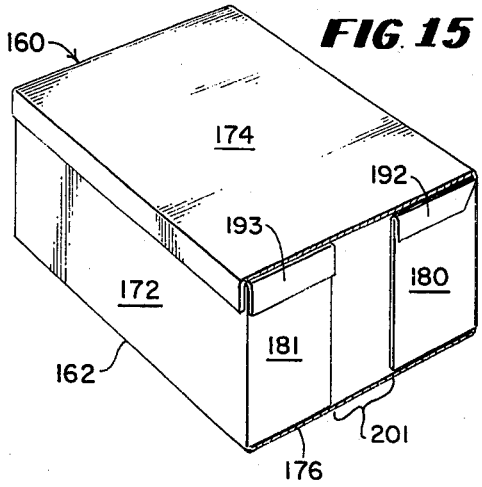
FIG. 10
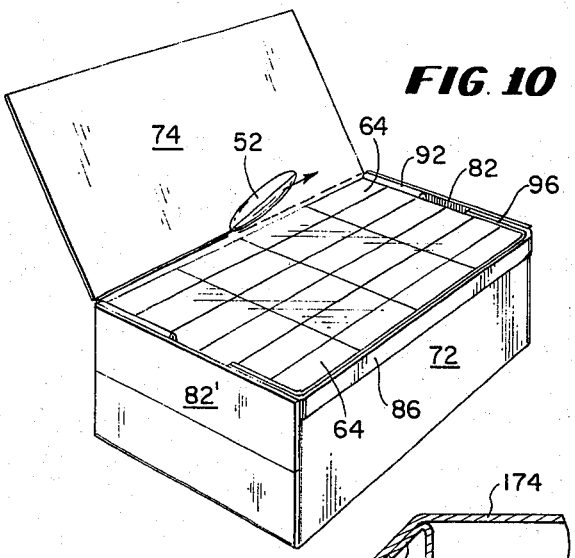
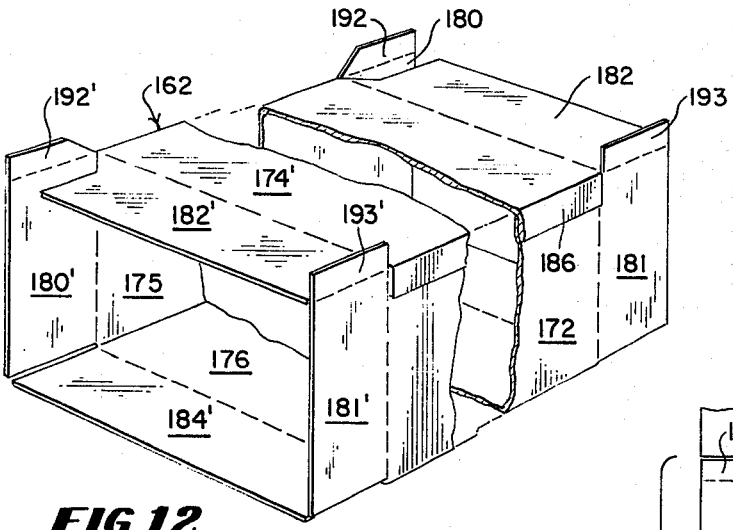
FIG. 12
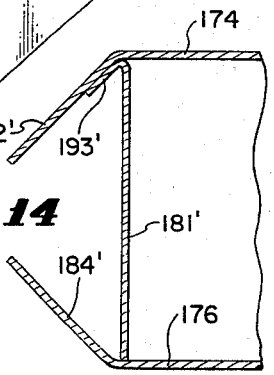
FIG. 14
FIG. 11
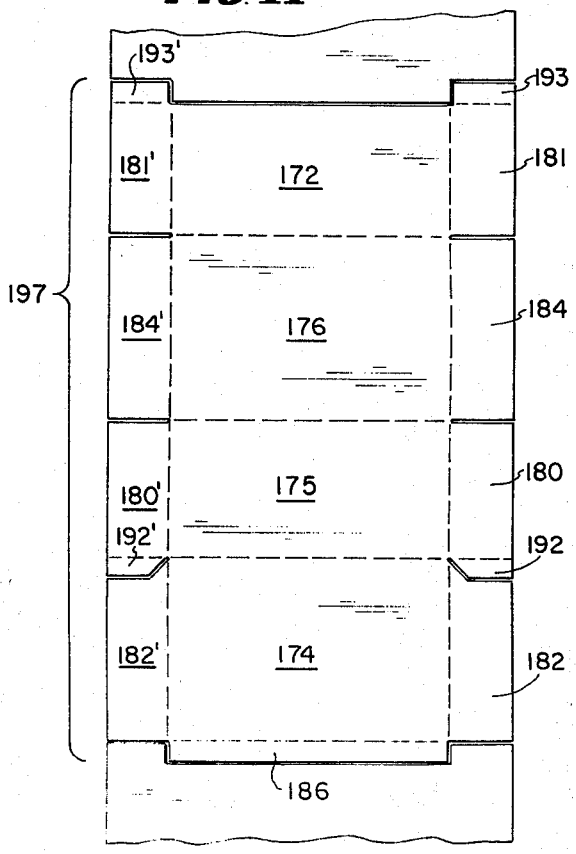
FIG. 13
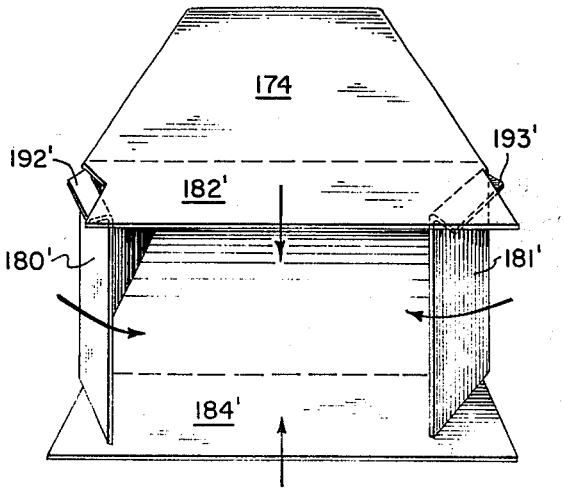

SPECIAL SHIPPING CASE HAVING MODIFIED END FLAPS

BACKGROUND OF THE INVENTION

This invention relates to a special shipping case for reducing damage of carton contents e.g. upon opening the case for price marking and stacking of the cartons on a store shelf, for example, as well as for increasing the strength of the shippers. The special case in accordance with this invention does not require additional material, additional assembly steps, or additional or modified filling and assembly equipment. Considerable problems have been encountered in connection with inadvertent cutting of ready-to-eat cereal cartons, and the like, by store clerks when shipping cases are opened for price marking of the contents. Typically the clerk will run the knife blade along two ends and a side of a case immediately below the top of the case in order to pivot the top open, and in some instances, the top of the case is removed entirely. Knives having a short blade of preset length are customarily used for this. A long standing problem has been the fact that cartons adjacent an outer wall of the case are likely to be cut. In recent investigation of this problem, it has been observed in laboratory tests that from 15 to 40 percent of the vulnerable cartons, that is, cartons immediately adjacent the outside of the shipping case, were cut or damaged by the store clerk's knife during removal of the shipping case top in the preparation for price marking of the contents. Although the packages in the shipping case which are adjacent the side panels are most likely to be damaged by clerk-cuts, a substantial number of packages adjacent the end walls, particularly those positioned at a flap-gap are damaged by clerk-cuts.

This problem has been found to have become particularly aggravated during the present trend towards higher density cereal products. While I do not intend to be bound by any theories of operation in connection with this invention, it is my belief based on repeated observation that in many instances a small gap is provided by the manufacturer between the top of a shipping case and the top of the content cartons. If the store clerk were to draw the opening knife along the outside of the shipping case in that top portion thereof which corresponds to the small gap between the top of the contents and the top of the shipping case, it is apparent that no substantial damage would occur to the contents of the case. However, it has been learned that upon stacking of cases on pallets, and upon stacking of loaded pallets on top of one another for storage, the weight forces involved generally result in the collapse of the small gap between the top of the content cartons and the top of the shipping case. This is particularly exaggerated in those instances involving a relatively high density product such as, for example, a high density natural ready-to-eat cereal as distinguished from a low density puffed ready-to-eat cereal. When the clerk draws the knife along the outside of the shipping case, regardless of how close to the top of the case the blade stays, the knife will probably, and in fact does damage a large percentage of the contents, using heretofore available shipping cases. Another common form of damage is that which results from partial crushing of the contents due to partial crushing of the shipping case assembly, for example, during storage, an illustrated embodiment of this invention gave substantially higher top to bottom compression test results, when in the storage position.

SUMMARY OF THE INVENTION

The store cut damage to shipping case carton contents adjacent the end flaps is substantially eliminated by providing a corrugated board shipping case assembly in accordance with the present invention.

In accordance with a preferred aspect of the present invention, the tops of the shipping case contents are arranged within a shipping case to be adjacent a top panel of the case, the top panel of the case having flaps dependent along at least three edges thereof. These flaps, in accordance with the present invention, depend from the top panel over the outside of the body of the case, and are free from attachment to the underlaying body of the shipping case along an elongated zone adjacent the edge of the top panel. The dependent flaps are secured, for example, by glueing, to the body of the case beyond the attachment-free zone. In particular, the case of this invention has a top panel with the dependent major end flaps overlaying both minor end flaps and are free of attachment to the minor end flaps at a zone along its edge adjacent the top panel, and are attached, for example by glueing, to the minor end flaps below the top unattached zone. In addition, in accordance with this invention, separator strips are provided at the top edge of the minor end flaps. Two preferred types of separator strips are disclosed; one is an extension of a glue lap, the other is a hinged flap integral with the minor end flap. Upon opening the case in accordance with the present invention, the drawing of the knife through the dependent flaps in the attachment-free zone along three edges of the top panel severs those edges of the top panel from the remaining portions of the dependent flaps which secure the top panel in its shipping configuration, permitting the top panel to be hinged upwardly, along its still attached edge, for price marking of the cartons inside. If desired, the top panel can be totally severed by cutting through the top panel along the hinged edge from the inside face of the top panel with no risk whatsoever to the contents.

In accordance with a preferred embodiment of the present invention, the improved shipping case is made from a single blank, requires no additional corrugated board, results in no waste of corrugated board, involves no additional assembly steps, and is assembled and filled and closed using unmodified conventional equipment. This invention will be described in general and with the aid of particularly preferred embodiments by means of the following description and drawings in which:

FIG. 1 is a perspective cut-away view of a shipping assembly in accordance with the PRIOR ART.

FIG. 2 is a perspective cut-away view of a shipping assembly in accordance with the present invention.

FIG. 3 is a fragmentary cross-sectional elevational view taken approximately along the line 3—3 of FIG. 2.

FIG. 4 is a fragmentary elevational cross-sectional view taken approximately along the line 4—4 of FIG. 2.

FIG. 5 is a fragmentary cross-sectional elevational view taken approximately along the line 5—5 of FIG. 2.

FIG. 10 is a perspective view of a case in accordance with the present invention which has been opened, illustrating the position of the knife during complete severing of the top panel.

FIG. 11 is a plan view of a blank of a case in accordance with an alternative embodiment of the present invention.

FIG. 12 is a perspective view of a partially assembled case in accordance with the present invention using the blank of FIG. 11.

FIG. 13 is a perspective view of a partially assembled case shown of FIG. 12 in which minor end flaps are being closed.

FIG. 14 is a fragmentary sectional front view of the case in FIG. 13 with the major end flaps being closed.

FIG. 15 is a fragmentary perspective view of the embodiment shown in FIGS. 11–14 with the major end flaps removed to illustrate configuration of the minor end flaps.

Figure 6:
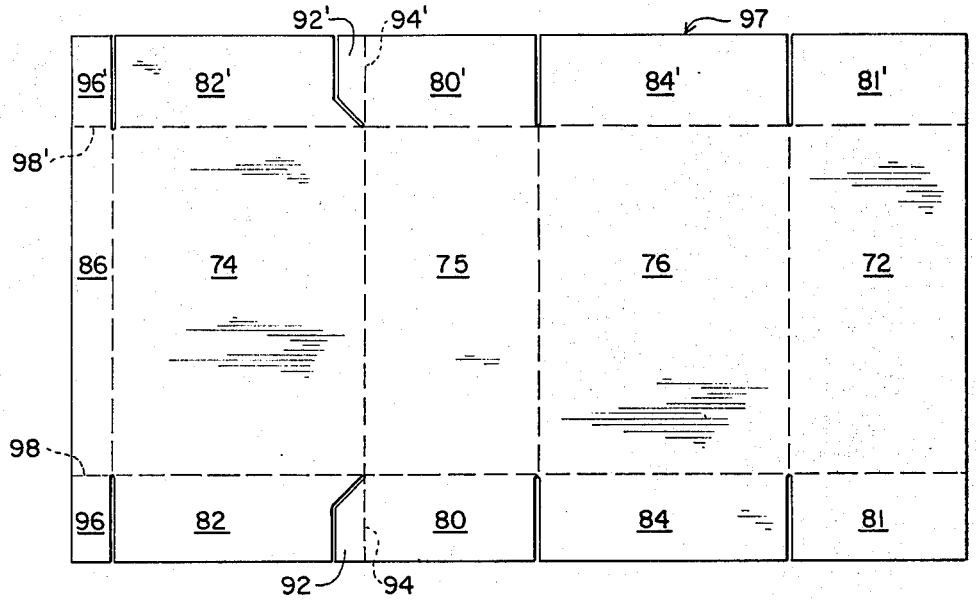
FIG. 6 is a plan view of a blank of a case in accordance with the present invention.

FIG. 1 is intended to illustrate the typical and very widely used structure in accordance with the prior art. A shipping assembly is generally indicated by the numeral 20 and includes a shipping case 22 having a plurality of packages 24 packed therein. It is noted that the packages 24 normally have indicia 26 imprinted thereon and that indicia 26 determines that one end 28 of package 24 is designated as the "top" of package 24. Typically indicia 30 is also provided at the top end 28 to facilitate price marking and price checking of the merchandise namely packages 24.

The shipping case 22 is typically manufactured from corrugated paperboard and includes a front panel 32, top panel 34, a rear panel (not shown), and a bottom panel 36. Each end wall generally indicated by the numeral 38 is made up of a pair of minor end flaps 40 folded and integrally hinged from the front panel 32 and the rear panel (not shown), and a pair of major end flaps 42, 44. A glue lap flap 46 is integral with and hinged to bottom panel 36 and is glued along glue lap 48 to the "bottom" of front panel 32. Thus, in accordance with the prior art, glue lap 48 is situated along the bottom of packages 24 and on the inside of front panel 32. A single layer of corrugated paperboard covers packages 24 at the top thereof at the top portion of panel 32 which is normally cut by the clerk's knife 52, for example. Upon opening of the case 22 with a knife 52 as indicated in FIG. 1 it has been discovered that the packages 24 which are adjacent the front panel 32 and rear panel 34 are virtually certain to be damaged by the clerk's knife 52. This damage typically results in a slash 54 in the face of one or more of the packages 24.

Typically the store clerks will place damaged packages 24 on the store shelves, and in many instances the damaged cartons are purchased, reluctantly, by the consumer. In an increasing number of instances, however, the consumer refuses to purchase store-cut packages and, in the absence of any good shipping assembly which eliminates the likelihood of store-cut cartons, reputable manufacturers, being sympathetic with the difficult position in which the store is placed, have policies in favor of buying back damaged merchandise from the store. This is a waste resources of time, effort and material and constitutes an undesirable hidden cost borne ultimately by the consumer.

In the following description of the shipping assembly in accordance with the present invention, and from the comparison of actual test data reported in FIGS. 11 and 12 it will be appreciated that the shipping assembly in accordance with the present invention substantially eliminates the store-cut package problem.

FIGS. 2–15 illustrate structures in accordance with the present invention. FIGS. 2–10 illustrate one preferred embodiment, FIGS. 11–15 illustrate a second preferred embodiment.

In FIG. 2 a shipping assembly in accordance with the present invention is generally indicated by the numeral 60. Assembly 60 comprises shipping case 62 and a plurality of packages 64 contained therein. Packages 64 have indicia 66 imprinted thereon which results in one end 68 of package 64 being regarded as the top. Additional indicia 70 on top end 68 is typically provided for price marking.

The end walls of case 62 are generally indicated by the numeral 78, 78′. End walls 78, 78′, respectively, each comprise a pair of minor end flaps 80, 80′, 81, 81′, top major end flaps 82, 82′ and bottom major end flaps 84, 84′. In addition a glue lap flap 86 is integral and hinged to top panel 74 and, in the assembled carton, overlaps the top edge of front panel 72 and is secured thereto. (See FIG. 3.) However, in accordance with the present invention, the glue lap flap 86 is not secured to front panel 72 along the top marginal zone 88 and is secured by glue, for example, along zone 90 which is parallel to and below or beyond zone 88. Zone 88 is positioned between glue zone 90 and top panel 74. The width of zone 88 is not critical, but it is preferred that it extend at least ¼ inch and preferably at least ½ to at least ⅝ inches from the bottom of top panel 74.

In accordance with the preferred embodiment illustrated in FIGS. 2–10 respective hinged flaps 92, 92′ are provided. Hinged flaps 92, 92′ are integral with and hinged to rear minor end flaps 80, 80′ along respective score lines 94, 94′ but, as will be appreciated from a consideration of FIG. 5, the material from which hinged flaps 92, 92′ are made is taken from what typically would have been material of major end flaps 82, 82′. FIGS. 2 and 4 shows hinged end flaps 92 folded down between minor end flap 80 and major end flap 82. The other hinged flap 92′ is similarly positioned between minor end flap 80′ and major end flap 92′.

Figure 7:
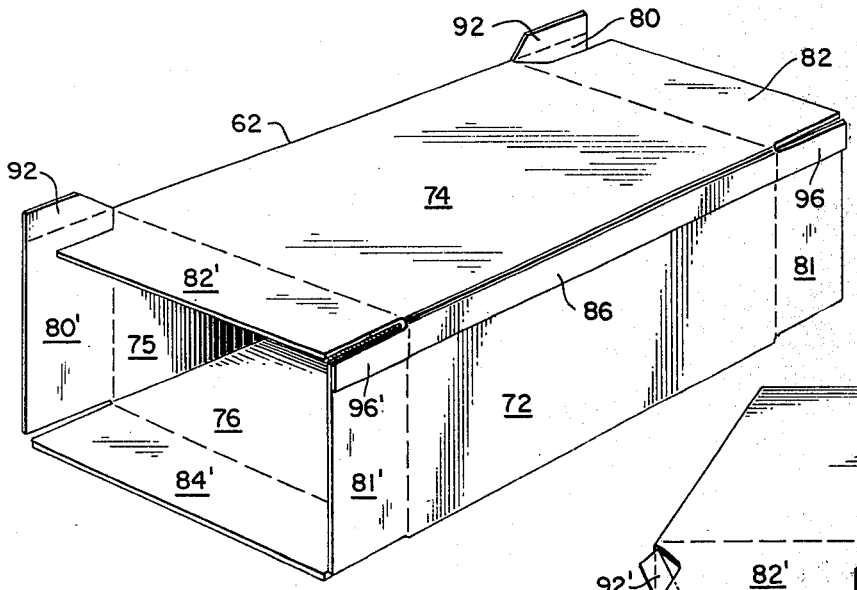
FIG. 7 is a perspective view of a partially assembled case in accordance with the present invention.

Also, in accordance with the preferred embodiment of this invention, glue lap flap 86 has laterally extending wings 96, 96′ respectively extending from either end thereof and being hinged thereto along respective score lines 98, 98′. Lap wings 96, 96′ are glued, respectively, to minor end flaps 81, 81′ as viewed in FIG. 7 so that, as shown in FIG. 5, the glue lap wings 96, 96′ are positioned between minor end flaps 81, 81′ as viewed in FIG. 7 so that, as shown in FIG. 5, the glue lap wings 96, 96′ are positioned between minor end flaps 81, 81′ and major end flaps 82, 82′ respectively. Referring now to FIG. 7, in which a partially assembled case 62 is shown, it will be appreciated glue lap wings 96, 96′ are secured to the faces of minor end flaps 81, 81′ respectively and glue lap flap 86 is secured, as illustrated in FIG. 3 to the outside of front panel 72.

Figure 8:
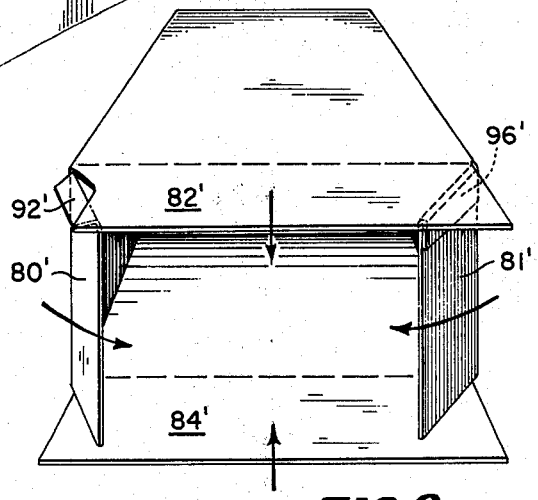
FIG. 8 is a perspective view of a partially assembled case in accordance with the present invention being closed to provide an improved assembly in accordance with the present invention.

Due to the inherent stiffness and resiliency of the corrugated paperboard material, hinged flaps 92, 92′ project upwardly from rear minor end flaps 80, 80′ when the case 62 is in the partially assembled tubular condition shown in FIG. 7. Thus, as illustrated in FIG. 8, when minor end flap 80 is folded frontwardly into alignment with front minor end flap 81 the hinged flap 92 is automatically tucked under major end flap 82' and the wing 96' is automatically pivoted under major end flap 82' as well. The same thing happens under the closing of the other end wall 78.

From a consideration of FIG. 6 it is apparent that the preferred shipping case of this invention can be made from a single blank 97.

It will be appreciated by those skilled in the art that the third layers of material provided by hinged flap 92, 92' and wings 96, 96' are incorporated into the preferred shipping assembly of the present invention without the consumption of any additional corrugated board, and it will also be appreciated that the assembly process in which the third, that is the middle layers of material provided by hinged flaps 92, 94' and wings 96, 96' is achieved automatically without the need for provision of additional equipment.

When a knife 52 is drawn through glue lap flap 86 with its blade passing through flap 86 in the unattached zone 88 the top panel 74 if severed from front panel 72, as indicated in FIG. 2 without damage to cartons 64 contained therein. Also, as shown in FIG. 9, I have discovered that such placement of a third layer of corrugated material provided by hinged flaps 92, 92' and attached wings 96, 96' increases the extent of separation between major end flap 82 and contents 64 in that end flap gap 101 between front and rear minor end flaps 80, 81, 80', 81' respectively.

Figure 9:
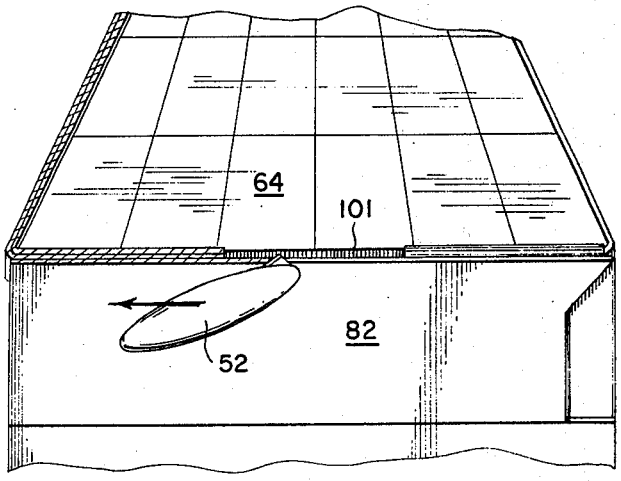
FIG. 9 is a perspective end view illustrating a case in accordance with the present invention being opened.

This is illustrated in FIG. 9 which shows the top panel 74 completely separated from the remaining portion of the assembly and in which shows the knife 52 positioned against major end flap 82. FIG. 10 illustrates the final separation of the top panel, if such should be desired, by drawing the knife 52 along that portion of panel 74 which is adjacent the remaining portion of the assembly 60.

An alternative preferred embodiment in accordance with the present invention is illustrated with the aid of FIGS. 11–15.

It will be appreciated that the case illustrated in FIGS. 11–15 includes many elements and structures, which correspond to elements and structures, referred to hereinbefore in connection with the embodiment illustrated in FIGS. 1–10. For the purpose of simplicity and in order to make this description concise, a description of the structure and the relationship of the respective parts will not be repeated herein except to note that the numbers used in the embodiment illustrated in FIGS. 11–15 correspond to the same numbers used to describe corresponding elements and structures described in connection with the embodiment illustrated in FIGS. 2–10 except that the numbers used in FIGS. 11–15 are in the 160–200 series. Hence, blank 197 in FIG. 11 corresponds to blank 97 referred to in FIG. 6, top panel 174 corresponds to top panel 74, and so on.

The following discussion, therefore, will be directed to the differences in the structures between case 162 and case 62. A consideration of FIG. 11, and specifically a consideration of blank 197 will reveal that the glue lap flap 186 does not include the laterally extending wings corresponding to extensions 96, 96'. In addition, it will be appreciated, at the end of blank 197 opposite to the end at which glue lap flap 186 that front minor end flaps 181, 181', at the top thereof, have integral hinged flaps 193, 193', respectively.

Partially assembled case 162 is shown in FIG. 12 in tubular configuration with hinged flaps 193, 193' extending upwardly from front minor end flaps 181, 181', respectively. In the configuration shown in FIG. 13 in which the ends are shown being closed, front and rear minor end flaps 180;, 181' are being pivoted between top and bottom major end flaps 182', 184'. The hinged flap 193' tucks under top major end flap 182 just as hinged flap 192' tucks under top major end flap 182'. When top and bottom major end flaps 182', 184' are pivoted to the "closed" configuration shown in FIG. 14 the hinged flap 193' is positioned between the minor flap 181' and the top major end flap 182'. Similar relationships are developed at the opposite end of case 162. Thus, as illustrated in FIG. 15, in which a fragmentary structure, having top and bottom major end flaps 182, 184 are shown as being removed therefrom, the hinged flaps 192, 193 are positioned outwardly of minor end flaps 180, 181.

Thus, the embodiment illustrated in FIGS. 11–15 provides a spacer strip, namely hinged flap 193, 193' which is fixed along its top edge to minor flap 181, 181', respectively instead of the structure provided in the embodiment shown in FIGS. 1–10 in which glue lap extensions 96, 96' are attached to front minor end flaps 81, 81', respectively.

Many variations and modifications can be incorporated into structures in accordance with this invention without departing from the spirit and scope of this invention. For example, hinged flaps 92, 93, 192, 193, 92', 93', 192', 193' can be abbreviated in length to reside only adjacent to minor end flap gap 101, 201. When the top mid-portion of minor end flaps 80, 80', 81, 81', 180, 180', 181, 181' it is the portion adjacent the respective top panel, and adjacent the respective mid-flap gap 101, 201 which is referred to. Also, hinged flaps 92, 92', 93, 93', 192, 192', 193, 193' can be glued to respective minor end flaps or to respective major end flaps. It is apparent that, in its broadest aspect the invention does not require that flaps 92, 92', 93, 93', 192, 192', 193, 193' be hinged to corresponding minor end flaps, but for ease of assembly and strength, the illustrated embodiments are preferred. Also, the preferred embodiment illustrates the incorporation of the invention in an end-loaded case. The use of the invention is not limited to end-loading cases, but is applicable to other cases, as well.

Also separator strips can be provided at both top and bottom edges of the minor end flaps, if desired.

As used herein the term "major" end flaps is intended to refer to flaps hinged to top or bottom panels, and "minor" end flaps is intended to refer to flaps hinged to side panels. The terms major and minor therefore are not intended to refer to relative size.

In a carefully observed test twelve shipping assemblies 20 and twelve shipping assemblies 60 in accordance with the present invention were opened by individuals who either were or have worked as stock clerks in stores. These persons were not briefed as to the purpose of the test, and were instructed to cut along dotted lines imprinted along the top edge of major end flaps 38, 38' and glue lap flap 86. In this test each person opened one prior art assembly 20 and one assembly 60 in accordance with the present invention. The packages 24 and 64 were then examined carefully and the position of those packages which were cut was noted and the results were tabulated. Specifically, the number of cut packages at each position were summarized.

In summary, five packages 24 positioned at the gaps 101 between minor end flaps 80, 81, and 80′, 81′ respectively were cut in the course of the opening of twelve cases 20. By comparison, none of the corresponding packages 64 were cut in the course of the opening of twelve cases 62. It was noted that none of the cartons 24 or 64 which were positioned entirely under minor end flaps 40, or 80, 81, 80′, 81′ were cut at that portion facing the end flaps. A total of twenty-three cartons 24 where facing front panel 32 and rear panel (not shown) of case 22 were cut. When case 60 in accordance with the present invention was used, not one single carton 64 suffered "store-cut" type damage.

When the shipping case 62 in accordance with the present invention as illustrated in FIG. 2 was compared with shipping case 22 in storage configuration top to bottom compression tests, it was found, quite unexpectedly, that case 62 was substantially stronger. In carefully controlled laboratory tests a large number of "repeat" tests were made of cases 22 and 62 in which top to bottom compression is evaluated using Gaynes compression tester, the top platen being lowered at ½ inch per minute, chart speed being 1 inch per minute, in the up to 1000 pound range. The corrugated board used in each of the cases 22, 62 was 175 pound-C flute. Controls (cases 20) gave results which ranged from 475 to 615 with an average of 556.5 pounds. Cases 62 in accordance with the present invention gave results which ranged from 575 to 725 with an average of 634. It is noted, however, that the results of compression tests of cases 62 in accordance with the present invention correlated with the extent to which major end flap 82, 82′ was glued to minor end flaps 80, 80′, 81, 81′. When top major end flaps 82, 82′ were glued normally to both minor end flaps 80, 80′, 81, 81′ the results of the top to bottom compression tests averaged 700 pounds. Thus, the cases 62 in accordance with the present invention gave strengths which were from about 14 to about 26 percent higher in the top to bottom compression tests than the results which were obtained under otherwise identical conditions using prior art cases 22.

I claim:

1. A tubular partially assembled blank corrugated shipping case comprising a top panel, side panels, and bottom panel, each of said panels being delineated by respective score lines; respective minor end flaps extending from each end of said side panels and being delineated therefrom by score lines therebetween, major end flaps extending from both ends of said top and bottom panels and being delineated therefrom by respective score lines, said minor and major end flaps being hinged to said respective panels, and being free of direct attachment to adjacent end flaps along the respective edges thereof; separator strips of corrugated material integral with said minor end flaps adjacent the top and middle edges of said minor end flaps; said major end flaps being unattached to said minor end flaps in a cutting zone along the entirety of the adjacent edges of the top panel, said major end flaps being secured to said minor end flaps below said zone.

2. A tubular partially assembled blank corrugated shipping case of claim 1 in which at least one of said separator strips consists essentially of a hinged flap integral with and hinged to said minor end flaps along a top edge thereof which is destined to be adjacent the top panel when said case is in assembled configuration.

3. The case of claim 2 in which said hinged flap is glued to said minor end flaps.

4. A tubular partially assembled corrugated shipping case of claim 1 in which at least one of said separator strips is derived from an extension of a glue lap flap integral with said top panel and overlaying said front panel, said glue lap flap extension being adhesively secured to said minor end flap.

5. The case of claim 1 in which said major end flaps are glued to said separator strips along a lower portion of said separator strips.

6. A shipping assembly comprising a corrugated paperboard shipping case comprising a top panel and having a plurality of containers packed therein; said containers having indicia imprinted thereon whereby one face of the respective containers is characterized as a respective top thereof; said containers being positioned within said case so that the respective tops of the containers underlay said top panel of the case; said case including major and minor end flaps; said case having ends thereof comprising a pair of minor end flaps each hinged along a respective edge of the body of the case which is substantially perpendicular with respect to the top panel said minor end flaps being free of attachment along the other edges thereof to a major end flap; said minor end flaps having relatively narrow separator strips secured thereto and positioned adjacent the top edge and the middle end thereof; said top panel of said shipping case having dependent major end flaps dependent from opposite edges of said top panel; said dependent flaps being overlaying respective pairs of said minor end flaps and being unattached to said minor end flaps in a cutting zone along the entirety of said opposing edges of said top panel, said dependent flaps being secured to said minor end flaps below said zone.

7. The shipping assembly of claim 6 in which at least one of said separator strips consists essentially of a hinged flap integral with and hinged to said minor end flaps along a top edge thereof which is destined to be adjacent the top panel when said case is in assembled configuration.

8. The shipping assembly of claim 7 in which said hinged flap is glued to said minor end flaps.

9. The shipping assembly of claim 6 in which at least one of said separator strips is derived from an extension of a glue lap flap integral with said top panel and overlaying said front panel, said glue lap flap extension being secured to said minor end flap.

10. The shipping assembly of claim 6 in which said major end flaps are glued to said separator strips along a lower portion of said separator strips.

11. A shipping assembly for facilitating store-cut removal of shipping case tops for price marking of content containers, and for substantially eliminating store-cut damage to the containers, said assembly comprising: a corrugated board shipping case comprising a top panel and having a plurality of containers packed therein; each of said containers having indicia thereon establishing a top and bottom of the respective containers, said containers being arranged in said shipping case with the tops of said containers being adjacent said top panel of said shipping case; dependent flaps dependent from said top panel along at least three edges thereof; said dependent flaps being free of attachment to the body of the case along an unattached marginal zone adjacent the edge of said top panel, said dependent flaps being secured to the body of the case below said marginal zone; said dependent flaps comprising a pair of major end flaps; front and rear minor end flaps underlaying each of said major end flaps and being free of attachment along the edges thereof to a major end flap; separator insert of corrugated material attached to each of siad minor end flaps adjacent the top and middle edges thereof.

12. An assembly of claim 11 in which said flaps are secured to said body by respective glue zones located beneath said unattached marginal zone.

13. A tubular partially assembled blank corrugated shipping case comprising a top panel, back panel, bottom panel and front panel, each of said panels being delineated by respective score lines; said top panel being secured to said front panel by means of a glue lap flap integral with said top panel and delineated by a score line between said glue lap flap and said top panel, said glue lap flap overlaying a portion of said front panel, said glue lap flap being unattached to said front panel along a zone adjacent said glue lap flap score line and secured to said front panel beyond said zone; said case also including major and minor end flaps, with respective minor end flaps extending from both ends of said front and rear panels and delineated therefrom by score lines therebetween, said minor end flaps being free of attachment along the edges thereof to a major end flap; major end flaps extending from both ends of said top and bottom panels and being delineated therefrom by respective score lines; said major end flaps being free of attachment to said minor end flaps along a top cutting zone, and being attached to said minor end flaps below said cutting zone; and separator strips attached to the minor end flaps adjacent the top and middle edges thereof.

14. The blank shipping container of claim 13 wherein the separator strips on the minor end flaps extending from the front panel consist essentially of extensions of said glue lap flap secured thereto on the edge of said minor end flaps destined to be adjacent said top panel upon complete assembly of the container; and wherein the separator strips on the respective minor end flaps extending from ends of the back panel consist essentially of integral tabs extending upwardly beyond the score line extension of the score line delineating the top and rear panels, said score line extension extending along that edge of said rear minor end flap destined to be adjacent the top panel upon complete assembly of said container.

* * * * *